US005198128A

United States Patent [19]

Beyer et al.

[11] Patent Number: 5,198,128

[45] Date of Patent: Mar. 30, 1993

[54] WASTE DISPOSAL SITE, IN PARTICULAR FOR THE ULTIMATE DISPOSAL OF RADIOACTIVE SUBSTANCES

[75] Inventors: Hellmuth Beyer, Erlangen; Ernst Haas, Buckenhof, both of Fed. Rep. of Germany

[73] Assignee: Siemens Aktiengesellschaft, Munich, Fed. Rep. of Germany

[21] Appl. No.: 711,367

[22] Filed: Jun. 5, 1991

Related U.S. Application Data

[63] Continuation of Ser. No. 215,215, Jul. 5, 1988, abandoned.

[30] Foreign Application Priority Data

Jul. 3, 1987 [DE] Fed. Rep. of Germany ..... 3722122

[51] Int. Cl.[5] ..... G21F 9/16

[52] U.S. Cl. ..... 252/628; 252/630; 252/633; 405/53; 405/128; 405/270; 376/313; 55/16; 55/22; 55/71; 55/74; 55/75; 55/97; 55/98; 55/158; 55/270; 55/389; 55/DIG. 9; 423/230; 423/237; 423/239; 423/240 R; 423/241; 423/240 S; 588/252

[58] Field of Search ..... 252/628, 630, 633; 405/53, 52, 128, 129, 270; 55/16, 22, 71, 74, 158, 75, 270, 97, 98, 389, DIG. 9; 376/313; 423/240, 241, 245, DIG. 20; 588/252

[56] References Cited

U.S. PATENT DOCUMENTS

| | | | |
|---|---|---|---|
| 3,080,307 | 3/1963 | Rinald | 252/630 |
| 3,848,067 | 11/1974 | Cooper | 252/630 |
| 4,016,242 | 4/1977 | Deitz et al. | 423/240 |
| 4,036,750 | 7/1977 | Jaros et al. | 210/669 |
| 4,040,802 | 8/1977 | Deitz et al. | 55/71 |
| 4,133,651 | 1/1979 | Hoy et al. | 55/75 |
| 4,135,896 | 1/1979 | Parish et al. | 55/270 |
| 4,186,085 | 1/1980 | Savage | 210/669 |
| 4,377,509 | 3/1983 | Haynes et al. | 252/633 |
| 4,428,700 | 1/1984 | Lennmann | 405/128 |
| 4,430,256 | 2/1984 | Rustum | 252/628 |
| 4,453,857 | 6/1984 | Sena et al. | 405/128 |
| 4,518,562 | 5/1985 | Deitz | 376/313 |
| 4,580,925 | 4/1986 | Matich et al. | 405/128 |
| 4,659,477 | 4/1987 | Macedo et al. | 252/630 |
| 4,695,561 | 9/1987 | Deitz | 252/630 |
| 4,701,280 | 10/1987 | Canevall | 252/633 |
| 4,778,628 | 10/1988 | Saha et al. | 252/633 |
| 4,784,802 | 11/1988 | Mallory et al. | 252/633 |

FOREIGN PATENT DOCUMENTS

| | | | |
|---|---|---|---|
| 1053918 | 5/1979 | Canada . | |
| 0037324 | 10/1981 | European Pat. Off. . | |
| 3438127 | 3/1986 | Fed. Rep. of Germany . | |
| 2181883 | 4/1987 | United Kingdom | 252/633 |

OTHER PUBLICATIONS

Ullmanns Encyklopädie der technischen Chemie, vol. 14, 4th Ed., p. 496, Chemie Weinheim 1977.

Kirk-Othmer Encyklopedia of Chemical Technology, vol. 16, 3rd Ed., pp. 351-352, John Wiley & Sons, N.Y., 1981.

Hollemann-Wiberg, Lehrbuch der Anorganischen Chemie, 90th Ed., p. 506, Walter de Gruyter, Berlin, N.Y., 1976.

*Primary Examiner*—Donald P. Walsh
*Assistant Examiner*—Ngoclan T. Mai
*Attorney, Agent, or Firm*—Herbert L. Lerner; Laurence A. Greenberg

[57] ABSTRACT

A waste disposal site, such as an ultimate disposal site for radioactive substances, includes installed waste having hollow spaces remaining therebetween. Packing material fills the remaining spaces. At least one substance to which gaseous toxic substances such as radioactive gases adhere, is admixed with the packing material.

14 Claims, No Drawings

WASTE DISPOSAL SITE, IN PARTICULAR FOR THE ULTIMATE DISPOSAL OF RADIOACTIVE SUBSTANCES

This application is a continuation of application Ser. No. 215,215 filed Jul. 5, 1988, now abandoned.

The invention relates to a waste disposal site, in particular an ultimate disposal site for radioactive substances, in which the hollow spaces that are left among waste in the disposal site are filled with a packing material.

Waste to be stored in a disposal site is often solid and therefore cannot be stored in a tightly packed condition. Hollow spaces therefore remain among the disposed-of waste. This is especially true if the waste that is to be stored is first placed in containers and then dumped, as is typically the case with radioactive waste. Radioactive waste, for instance, is first put into containers and then stored in an ultimate disposal site. Hollow spaces remain between the containers.

The packing is unstable because of the hollow spaces in the waste material stored in a waste disposal site. During the course of storage, the stored material can shift, which can cause surface changes and can even lead to the escape of waste substances. It is therefore typical to fill any hollow spaces that remain when the waste is put into storage with a filler or "packing material". Various bulk solids are used for this purpose.

In the ultimate disposal of radioactive waste in a former salt mine, the hollow spaces are filled with salt, for instance, which is available in sufficient quantity. In prior art disposal sites, the packing material serves exclusively for assuring the mechanical stability of the disposal site.

In conventional waste disposal sites, various gases are produced during the storage. These gases are only partially retained in the solids of the disposal site. Another portion of the gases which are produced escapes from the disposal site. In ultimate disposal sites for radioactive substances, the gases produced may contain radioactive isotopes.

It is accordingly an object of the invention to provide a waste disposal site, in particular for the ultimate disposal of radioactive substances, which overcomes the hereinafore-mentioned disadvantages of the heretofore-known devices of this general type and which considerably improves the bonding of the gases produced in a waste disposal site to the solids of the disposal site. The intention is to bind such a high proportion of the gases in this way that any escape of gases is greatly delayed or even virtually precluded.

With the foregoing and other objects in view there is provided, in accordance with the invention, a waste disposal site, especially an ultimate disposal site for radioactive substances, comprising installed waste having hollow spaces remaining therebetween, packing material filling the remaining spaces, and at least one substance to which gaseous toxic substances such as radioactive gases adhere, being admixed with the packing material.

It has been recognized that gases are retained, in particular by means of the packing material. Either a reversible or an irreversible bonding of the gas to the packing material takes place. In the first case, an equilibrium is established between the concentrations of retained substances in the gas phase and in the packing material. A standard for the bonding of gas to the packing material is the retardation factor, which can be derived from the quotient of the gas quantity bound to the packing material and the gas quantity emitted by the packing material.

In the second case, that is in an irreversible bonding of the gas to the packing material, the retained substance is completely withdrawn from the gas phase and is no longer liberated. In an irreversible bonding, the retardation factor is infinitely high.

All conventional packing materials have a retardation factor that for most gases is close to 1. According to the invention, the retention capacity of the packing material is decisively improved for the first time by the admixture of a suitable substance to which gases adhere.

The waste disposal site constructed in accordance with the invention provides the advantage of binding gases produced in the disposal site to the packing material with a high retardation factor. In accordance with the invention, gases produced in the disposed-of waste remain largely bound in the waste disposal site and either do not reach the outside or only reach the outside after a major delay.

In accordance with another feature of the invention, the packing material (which is formed of a multiplicity of solid particles) is a bulk material, such as iron ore, rock, a mixture of iron ore and secondary rock, or salt. The selection depends primarily on the question of which substance is available at a favorably economical cost.

In accordance with a further feature of the invention, the at least one substance admixed with the packing material is carbon residue of pyrolysis. This is an example of a suitable substance to be admixed with the packing material and to which gaseous toxic substances adhere.

The use of carbon residue of pyrolysis provides the advantage of considerably increasing the retardation factor for gases of the packing materials which are typically used.

In accordance with an added feature of the invention, 20% by weight of the carbon residues of pyrolysis is admixed with the packing material. For example, if iron ore, secondary rock (rock which is removed from an ore mine but does not contain ore), or a mixture of the two is admixed with 20% by weight of carbon residue of pyrolysis the retardation factor for gaseous methyl iodide rises, by comparison with packing material without the admixture, from a value of 1 to a value of 1500.

Methyl iodide, which contains radioactive iodine, occurs in ultimate disposal sites for radioactive substances. An ultimate disposal site of this kind should be installed in a former iron ore mine. In such a location, iron ore and secondary rock are used as the packing material, for reasons of economy.

Due to the carbon residue of pyrolysis admixed in accordance with the invention, the emission of especially radioactive iodine, from such an ultimate disposal site for radioactive substances, is largely precluded.

An increased retardation factor and therefore a better retention capacity for gases are also attainable by means of carbon residue of pyrolysis in combination with other packing materials.

The action of carbon residue of pyrolysis in this respect is independent of the type of packing material used.

Furthermore, the action of carbon residue of pyrolysis is not limited to the retention of iodine in the form of methyl iodide, $CH_3I$. Other gases containing radioactive isotopes that can occur in ultimate disposal sites are also retained. Such gases are, for example, noble gases, $CO_2$, HCl, $I_2$, $NH_3$, $SO_2$ or $H_2S$.

Non-radioactive, inorganic or organic gases that occur in waste disposal sites are also retained in the disposal site because of the admixture of carbon residue of pyrolysis with the packing materials according to the invention.

A further decisive advantage of the use of carbon residue of pyrolysis according to the invention is that carbon residue of pyrolysis is available in large quantities at extremely low costs. Furthermore, carbon residue of pyrolysis is usefully removed in the waste disposal site according to the invention. Carbon residue of pyrolysis , which is produced as a byproduct in pyrolysis, previously had to be handled as toxic waste.

For example, in accordance with a concomitant feature of the invention, instead of carbon residue of pyrolysis, the at least one substance admixed with the packing material is a residue from hydrocarbon pyrolysis, a residue from low-temperature carbonization of oil shale, or activated charcoal. With these substances as well, the retardation factor and therefore the retention capacity of packing materials for gases is increased. By using the residues from the hydrocarbon pyrolysis or low-temperature oil shale carbonization, a further advantage which is that of usefully eliminating a substance that must be handled as toxic waste is attained, as with the use of carbon residue of pyrolysis.

A particular advantage of the waste disposal site according to the invention is that gases produced in the waste are retained. This advantage is particularly great for radioactive gases which form in ultimate disposal sites for radioactive substances. Furthermore, the aforementioned advantage is attained by using substances that would otherwise have to be removed as toxic waste. Additionally, the structure and operation of a waste disposal site according to the invention are feasible at favorable cost.

Other features which are considered as characteristic for the invention are set forth in the appended claims.

Although the invention is described herein as embodied in a waste disposal site, in particular for the ultimate disposal of radioactive substances, it is nevertheless not intended to be limited to the details given, since various modifications and structural changes may be made therein without departing from the spirit of the invention and within the scope and range of equivalents of the claims.

The construction and method of operation of the invention, however, together with additional objects and advantages thereof will be best understood from the preceding description of specific embodiments.

We claim:

1. Ultimate disposal site for radioactive waste, comprising containers containing the radioactive waste, said containers being installed in a cave and defining hollow spaces remaining in the cave, and a mixture filling said hollow spaces, said mixture including at least one packing material and at least one substance to which radioactive gaseous substances adhere.

2. Ultimate disposal site according to claim 1, wherein said at least one substance admixed with the packing material is carbon residue of pyrolysis

3. Ultimate disposal site according to claim 2, wherein 20% by weight of said carbon residue of pyrolysis is admixed with said packing material.

4. Ultimate disposal site according to claim 1, wherein said at least one substance admixed with said packing material is a residue from hydrocarbon pyrolysis.

5. Ultimate disposal site according to claim 1, wherein said at least one substance admixed with said packing material is a residue from low-temperature carbonization of oil shale.

6. Ultimate disposal site according to claim 1, wherein said at least one substance admixed with said packing material is activated charcoal.

7. Ultimate disposal site according to claim 1, wherein said packing material includes a multiplicity of solid particles.

8. Ultimate disposal site according to claim 7, wherein said packing material is iron ore.

9. Ultimate disposal site according to claim 7, wherein said packing material is rock.

10. Ultimate disposal site according tc claim 7, wherein said packing material is a mixture of iron ore and secondary rock.

11. Ultimate disposal site according to claim 7, wherein said packing material is a salt.

12. Ultimate disposal site for radioactive waste, comprising a cave, containers for radioactive waste disposed in said cave and defining hollow spaces remaining in the cave, and a mixture filling said hollow spaces, said mixture including a packing material and a substance to which radioactive gaseous substances adhere.

13. The ultimate disposal site according to claim 1, wherein said containers define hollow spaces therebetween and wherein all of said hollow spaces are filled with said mixture.

14. The ultimate disposal site according to claim 12, wherein said cave has walls and said hollow spaces are defined among said containers and between said containers and said walls, and wherein said mixture fills substantially all of said hollow spaces.

* * * * *